US008081113B2

(12) United States Patent
Yu et al.

(10) Patent No.: US 8,081,113 B2
(45) Date of Patent: Dec. 20, 2011

(54) APERTURE COUPLED MICROSTRIP ANTENNA

(75) Inventors: Ming-Ju Yu, Cuishan Shiang (TW); Hsin-Chung Li, Cuishan Shiang (TW)

(73) Assignee: Delta Networks, Inc., Taoyuan County (TW)

( * ) Notice: Subject to any disclaimer, the term of this patent is extended or adjusted under 35 U.S.C. 154(b) by 457 days.

(21) Appl. No.: 11/880,254

(22) Filed: Jul. 20, 2007

(65) Prior Publication Data

US 2008/0158066 A1 Jul. 3, 2008

(30) Foreign Application Priority Data

Dec. 29, 2006 (TW) ..... 95150089 A

(51) Int. Cl.
*H01Q 1/38* (2006.01)

(52) U.S. Cl. ..... 343/700 MS; 343/748

(58) Field of Classification Search ..... 343/700 MS, 343/748

See application file for complete search history.

(56) References Cited

U.S. PATENT DOCUMENTS

| | | | | |
|---|---|---|---|---|
| 5,241,321 | A * | 8/1993 | Tsao | 343/700 MS |
| 6,292,143 | B1 * | 9/2001 | Romanofsky | 343/700 MS |
| 2003/0052825 | A1 | 3/2003 | Rao et al. | |
| 2006/0132359 | A1 | 6/2006 | Chang et al. | |

FOREIGN PATENT DOCUMENTS

| | | |
|---|---|---|
| EP | 1 341 258 A1 | 3/2003 |
| EP | 1 617 513 A1 | 1/2006 |
| JP | 62165403 | 7/1987 |

OTHER PUBLICATIONS

K.F.Lee et al., "Annular-Ring and Circular-Disc Microstrip Antennas With & Without Air Gaps", 13th European Microwave Conference, pp. 389-394.

Eli Aloni et al., "Analysis of a Dual Circularly Polarized Microstrip Antenna Fed by Crossed Slots", IEEE Transactions on Antennas and Propagation, vol. 42, No. 8, Aug. 1994, pp. 1053-1058.

Yi-Lung Lee et al., "Ring-Slot-Coupled Microstrip Patch Antenna for Circular Polarization", Microwave and Optical Technology Letters, vol. 44, No. 5, Mar. 5, 2005, pp. 453-456.

Jeen-Sheen Row, "Design of Aperture-Coupled Annular-Ring Microstrip Antennas for Circular Polarization", IEEE Transactions on Antennas and Propagation, vol. 53, No. 5, May 2005, pp. 1779-1784.

I.J. Bahl et al., "A New Microstrip Radiator for Medical Applications", IEEE Transactions on Microwave Theory and Techniques, vol. MTT-28, No. 12, Dec. 1980, pp. 1464-1468.

Sami M. Ali, Vector Hankel Transform Analysis of Annular-Ring Microstrip Antenna, IEEE Transactions on Antennas and Propagation, vol. AP-30, No. 4, Jul. 1982, pp. 637-644.

* cited by examiner

*Primary Examiner* — Dieu H Duong

(74) *Attorney, Agent, or Firm* — Haverstock & Owens LLP

(57) ABSTRACT

A microstrip antenna is provided. The microstrip antenna includes a first substrate with a first surface and a second surface paralleled to each other, a metal ground plane with an aperture disposed on the first surface and exposing parts of the first substrate via the aperture and a metal feed line disposed on the second surface, the metal feed line has at least two intersections with the aperture on a horizontal projection plane, in order to feed a signal received or transmitted by the microstrip antenna.

17 Claims, 16 Drawing Sheets

APERTURE COUPLED MICROSTRIP ANTENNA

FIELD OF THE INVENTION

The present invention relates to a microstrip antenna. In particular, the present invention relates to an aperture coupled microstrip antenna.

BACKGROUND OF THE INVENTION

One Antenna is a coupling element or a conductive system interchanging electromagnetic energy of the circuit. When transmitting the signal, the electricity of the radio frequency is transferred by the antenna to the electromagnetic energy and is radiated to the surroundings. When receiving the signal, the electromagnetic energy received by the antenna is transferred to the electricity of the radio frequency which is provided and accessed to the processor. Generally speaking, the characteristic and the efficiency of the antenna are obtained from the parameters, such as operation frequency, radiation pattern, return loss, and antenna gain, etc., wherein the radiation pattern resulting from the antenna radiate energy in all directions is the characteristic of the antenna radiation described as the space function by the figure.

Due to the different communication products have different restriction or function, the antenna design for radiant or received signals have diversities, such as dipole antenna, monopole antenna, traveling-wave wire antenna, helical antenna, spiral antenna, ring antenna, microstrip antenna, and print antenna, etc. In the wireless network application, the products having excellent covering range on the horizontal plane are needed, so the dipole antenna is generally used to obtain the omnidirectional radiation pattern. However, the drawbacks of the dipole antenna lies in that the dipole antenna is protruded from the product and the product volume and the difficulty of the design are increased. The microstrip antenna has the advantages of small volume, light weight, low cost and easy production. Therefore, for further minimizing the product volume, the microstrip antenna is an adoptable means.

The current microstrip antenna includes many feeding methods, such as coaxial cable feed, microstrip feed, and coplanar waveguide (CPW) feed, etc., wherein the method of using coaxial cable feed is more common. Please refer to FIG. 1, which is a structural diagram showing a coaxial cable fed (ring-shaped) microstrip antenna according to the prior art. In FIG. 1, a microstrip antenna 10 includes a plane-shaped dielectric substrate 101, a radiant metal sheet 102, a metal ground plane 105, and a coaxial cable 103. The radiant metal sheet 102 is disposed on one side of the dielectric substrate 101, and the metal ground plane 105 is stuck on another side of the dielectric substrate 101. The coaxial cable 103 passes through the metal ground plane 105 and is connected to radiant metal sheet 102. When receiving the signal, the electromagnetic energy radiation received by the radiant metal sheet 102 is transferred to a current of the radio frequency transmitted and accessed to the receptor by the coaxial cable 103. In the same way, when transmitting the signal, the current signal of the radio frequency transmitted from the coaxial cable 103 is transferred by the radiant metal sheet 102 to the electromagnetic energy radiation. The drawback of the microstrip antenna fed into the coaxial cable is the narrow bandwidth, and it is generally used in the mobile phone with the narrower bandwidth demand, such as GSM system. However, the bandwidth is about 3% in the 2.4 GHz application, which is insufficient to provide enough bandwidth in the standard of 802.11b/g in the presently mainstreamed wireless network.

In order to increase the effective bandwidth of the microstrip antenna, another current feed method is achieved by using aperture couple. Please refer to FIG. 2, which is a structural diagram showing an aperture coupled microstrip antenna according to the prior art. In FIG. 2, the aperture coupled microstrip antenna 20 includes two substrates 2011 and 2012, a radiant metal sheet 202 with a spectacular shape stuck on one side of the first substrate 2011, and a metal ground plane 205 stuck on one side of the second substrate 2012 arranged near to the first substrate 2011. The metal ground metal 205 includes an aperture 203 exposing the second substrate 2012, and a metal feed line 204 exposing on another side of the second substrate 2012 which received and transmitted the current signal with a specific frequency through the aperture 203. The bandwidth is increased about 6% by using microstrip antenna coupled with an aperture, but the present ring antennas in general all are the fundamental mode of the excited antenna. Moreover, the radiation pattern of the ring antenna is provided as a single direction in the fundamental mode and restricted in the application. At the same time, it remains to be insufficient for the progressive wireless surroundings.

It is therefore attempted by the applicant to deal with the above situation encountered in the prior art.

SUMMARY OF THE INVENTION

According to one aspect of the present invention, the microstrip antenna includes a first substrate with a first surface and a second surface paralleled to each other, a metal ground plane with an aperture disposed on the first surface and exposing parts of the first substrate via the aperture, and a metal feed line disposed on the second surface, the metal feed line has at least two intersections with the aperture on a horizontal projection plane, in order to feed a signal received or transmitted by the microstrip antenna.

According to another aspect of the present invention, the aperture is a rectangular aperture with a longer side and a shorter side, and the metal feed line having a first and a second intersections with the longer side of the rectangular aperture on the horizontal projection plane has an endpoint and a current feeding point, wherein the first intersection is arranged near to the endpoint, the second intersection is arranged near to the current feeding point, and the length from the endpoint to the second intersection ranged between $$\frac{(2\times n-1)}{2}\times L \text{ and } n\times L,$$

wherein n is a positive integer, L is a wavelength of an applied frequency of the microstrip antenna.

According to further another aspect of the present invention, the microstrip antenna further includes a second substrate paralleled to the first substrate, wherein the second substrate has a radiant metal sheet with a ring shape.

According to further another aspect of the present invention, the rectangular aperture passes through the radiant metal sheet on the horizontal projection plane and lies in a radial direction of the ring shape.

According to further another aspect of the present invention, the metal feed line is a continuous bending segment including a first segment and a second segment, wherein the first segment passes through the endpoint and the first intersection, the second segment passes through the current feeding point and the second intersection, and the first segment and the second segment are arranged near to the inner edge and the outer edge of the ring shape, respectively.

According to further another aspect of the present invention, the first and the second segment are perpendicular to the longer side of the rectangular aperture on the horizontal projection plane.

According to further another aspect of the present invention, at least one of the first substrate and the second substrate is a dielectric substrate.

According to further another aspect of the present invention, the metal feed line further includes a third segment connected the first segment and the second segment.

According to further another aspect of the present invention, the third segment is parallel to the longer side of the rectangular aperture on the horizontal projection plane.

According to further another aspect of the present invention, the microstrip antenna includes a metal ground plane disposed on a first plane and having an aperture formed thereon, and a feed line disposed in a second plane paralleled to the first plane, wherein the feed line has at least two intersections with the aperture on a horizontal projection plane, in order to feed a signal received and transmitted by the microstrip antenna.

According to further another aspect of the present invention, the feed line is formed by a metal material.

According to further another aspect of the present invention, the first plane and the second plane are disposed on a dielectric substrate with a first surface and a second surface, where the first plane and the second plane are carried by the first surface and the second surface, respectively.

According to further another aspect of the present invention, the microstrip antenna further includes a radiant metal sheet with a ring shape formed in a third plane paralleled to the first plane, and the third plane is arranged in an opposite side of the first plane with respect to the second plane.

According to further another aspect of the present invention, the aperture is a rectangular aperture with a longer side and a shorter side, the longer side of the rectangular aperture is formed in a radial direction of the radiant metal sheet on the horizontal projection plane, and an extension line of the longer side passes through a center point of the radiant metal sheet.

According to further another aspect of the present invention, the radiant metal sheet is formed on a dielectric substrate.

According to further another aspect of the present invention, the first plane and the second plane are insulated by an air medium, so are the second plane and the third plane.

According to further another aspect of the present invention, the feed line is a continuous bending segment including a first segment and a second segment, wherein the feed line further includes a curved segment connected the first segment and the second segment.

According to further another aspect of the present invention, the curved fragment is an arc.

According to the modulation method for a microstrip antenna couple with an aperture of the present invention, the microstrip antenna includes one metal ground plane, one feed line, and one radiant metal sheet, wherein the metal ground plane is formed on a first plane, the feed line is formed on a second plane paralleled to the first plane, the radiant metal sheet is formed on a third plane paralleled to the first plane, and the second plane and the third plane are arranged on different sides of the first plane. The modulation method includes the steps of: (a) performing a simulation of the microstrip antenna in a relatively higher order operation mode, in order to obtain a current distribution of the radiant metal sheet in the relatively higher order operation mode, (b) adjusting a location and a shape of the feed line, in order that a current distribution of the feed line and the current distribution of the radiant metal sheet in the same phase area have their respective maximum values, and (c) obtaining a matched impedance by adjusting the feed line, in order to excite the microstrip antenna operated in the relatively higher order operation mode and obtain an omnidirectional radiation pattern of the microstrip antenna.

According to another aspect of the modulation method for a microstrip antenna coupled with an aperture of the present invention, the abovementioned step (b) further includes a step of adjusting the feed line passing through the aperture at least two times on the horizontal projection plane.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The present invention is considered to excite the relatively higher order operation mode of the ring antenna by using the aperture couple, so as to improve the single-directional radiation pattern of the aperture coupled microstrip antenna in the present fundamental mode. However, the aperture couple method according to the prior art can not always achieve the efficient impedance in the relatively higher order operation mode of the excited ring antenna. In order to overcome the difficulty, the feed line is adjusted in the present invention, the current phase distribution of the feed line is matched to the current distribution of the ring antenna. Therefore, the relatively higher order operation mode of the efficient excited ring antenna is obtained and the boardband result is successfully reached.

Figure 1:
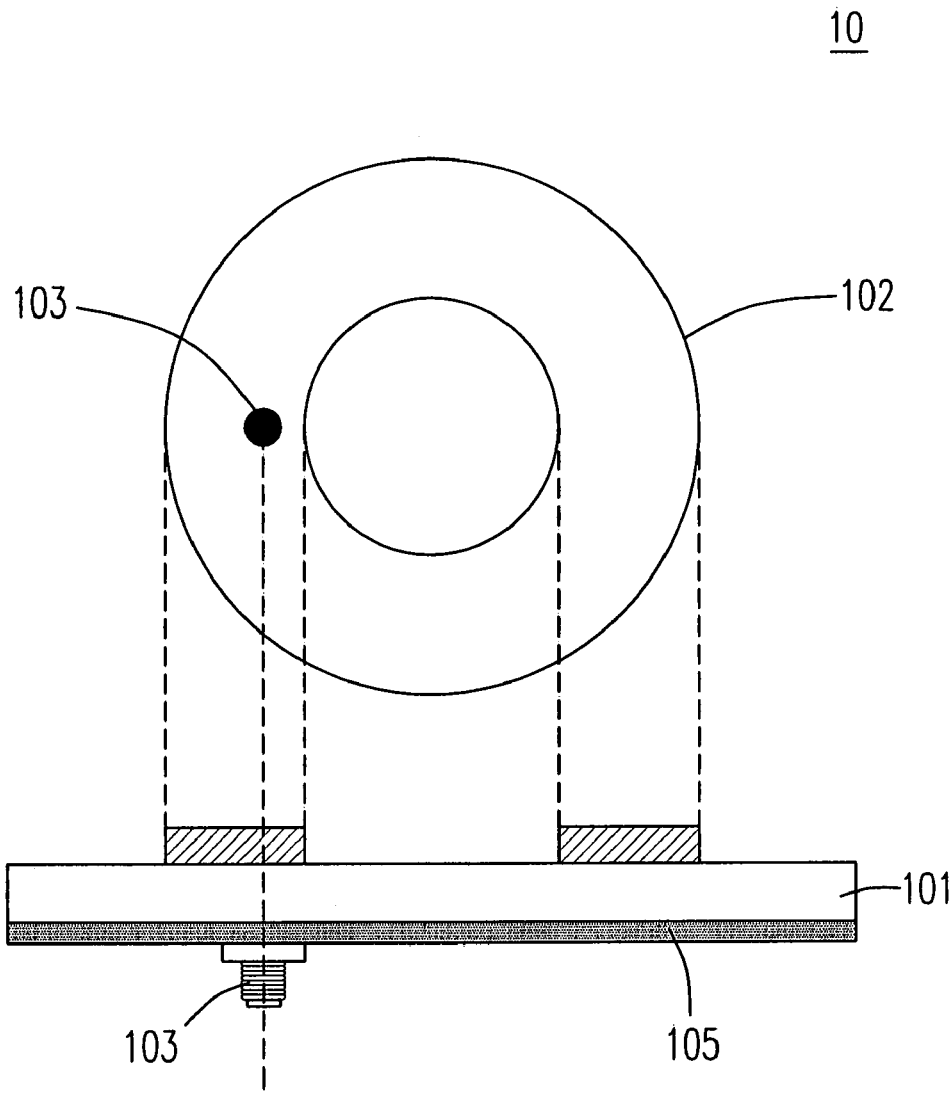
Fig. 1 (PRIOR ART)
FIG. 1 is a structural diagram showing a coaxial cable fed microstrip antenna according to the prior art.
Figure 2:
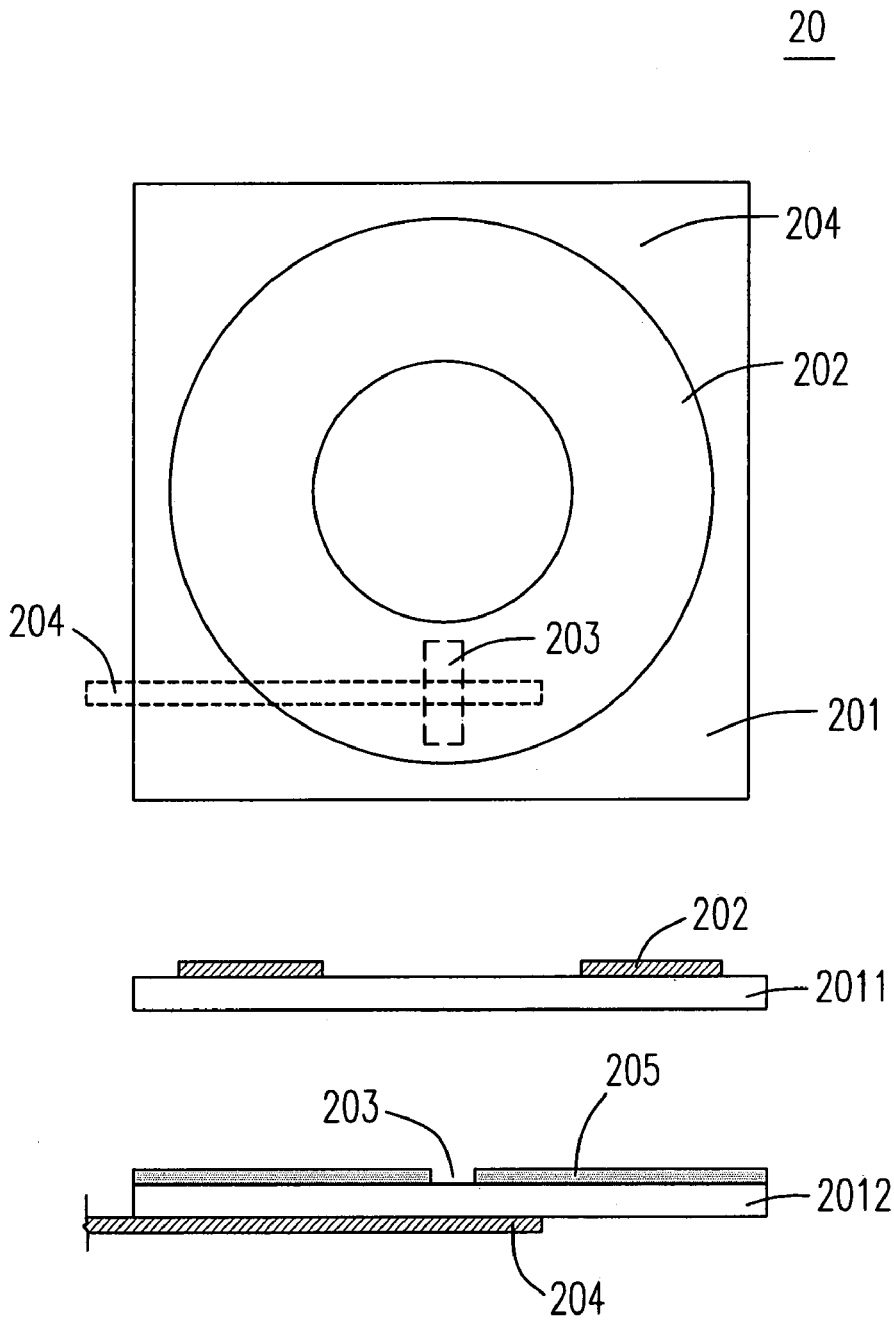
Fig. 2(PRIOR ART)
FIG. 2 is a structural diagram showing an aperture coupled microstrip antenna according to the prior art.
Figure 3:
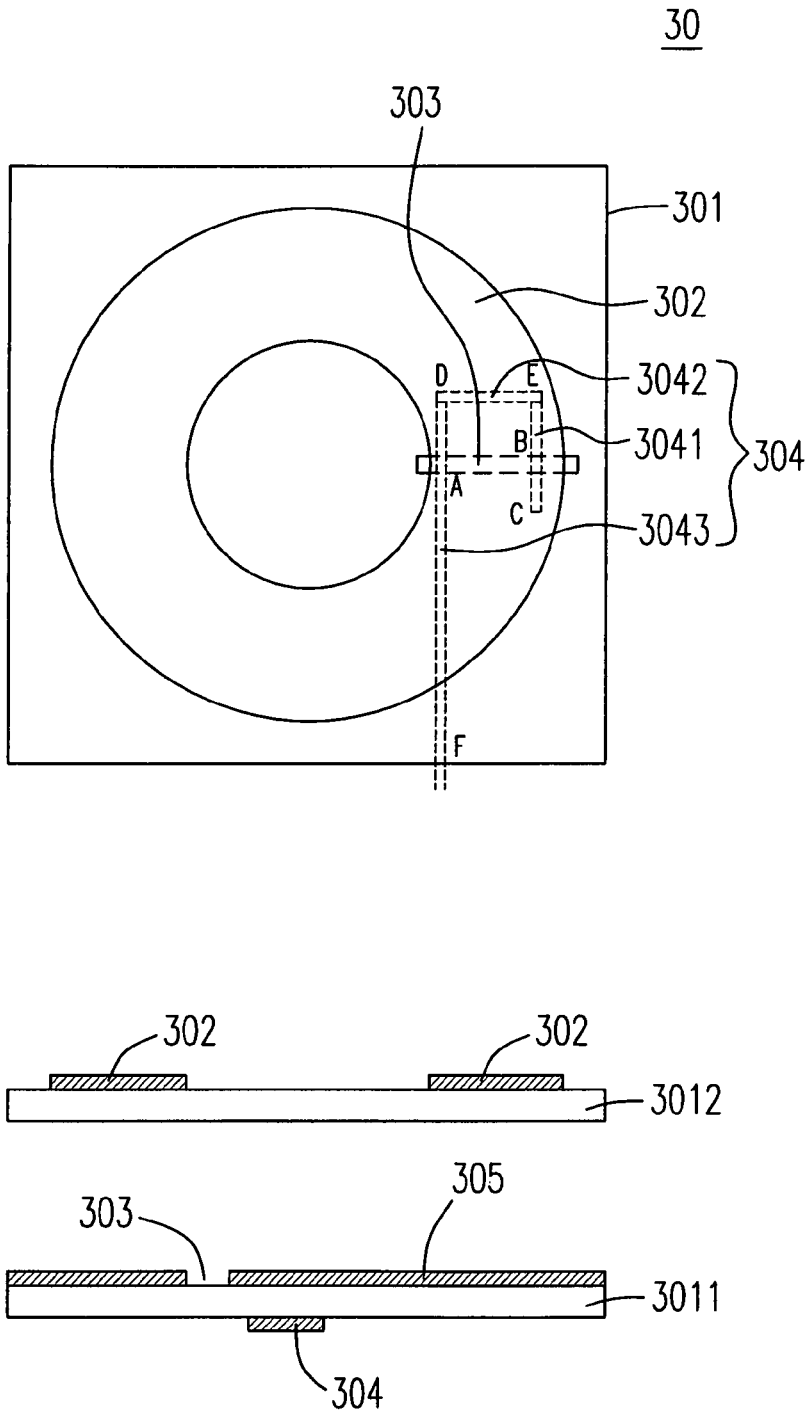
FIG. 3 is a structural diagram showing a microstrip antenna in accordance with a first preferred embodiment of the present invention.

Please refer to FIG. 3, which is a structural diagram showing a microstrip antenna in accordance with a first preferred embodiment of the present invention. In FIG. 3, a microstrip antenna 30 includes a first substrate 3011 and a second substrate 3012, wherein the second substrate 3012 is disposed and paralleled to the first substrate 3011 and the gap is reserved within two substrates, a ring-shaped radiant metal sheet 302 formed on the upper surface of the second substrate 3012, a metal ground plane 305 stuck on the upper surface of the first substrate 3011 arranged near to the second substrate 3012, a rectangular aperture 303 formed in the middle of the metal ground plane 305 in order to expose parts of the first substrate 3011, and a metal feed line 304 formed in the lower surface of the first substrate 3011 fed the signal received or transmitted by the microstrip antenna. The metal feed line 304 includes a endpoint C and a feeding point F linked to a signal processor (not shown in the figure), and a bending shape is formed on the horizontal projection plane. The metal feed line 304 passes through one side of the rectangular aperture 303, bends and passes through the opposite side of the rectangular aperture 303 on the horizontal projection plane. Then an intersection A and another intersection B are formed on the horizontal projection plane, wherein the intersection A is arranged near to the feeding point F in the metal feed line 304 and the intersection B is arranged near to the endpoint C.

The metal feed line 304 arranged near to the inner edge and the outer edge of the ring-shaped radiant metal sheet 320 is linear, including a first segment (L1) 3041 arranged near to the outer edge and a second segment (L2) 3043 arranged near to the inner edge, wherein the first segment (L1) 3041 passes through the intersection B and the endpoint C and the second segment (L2) 3043 passes through the intersection A and the feeding point F.

Figure 4:
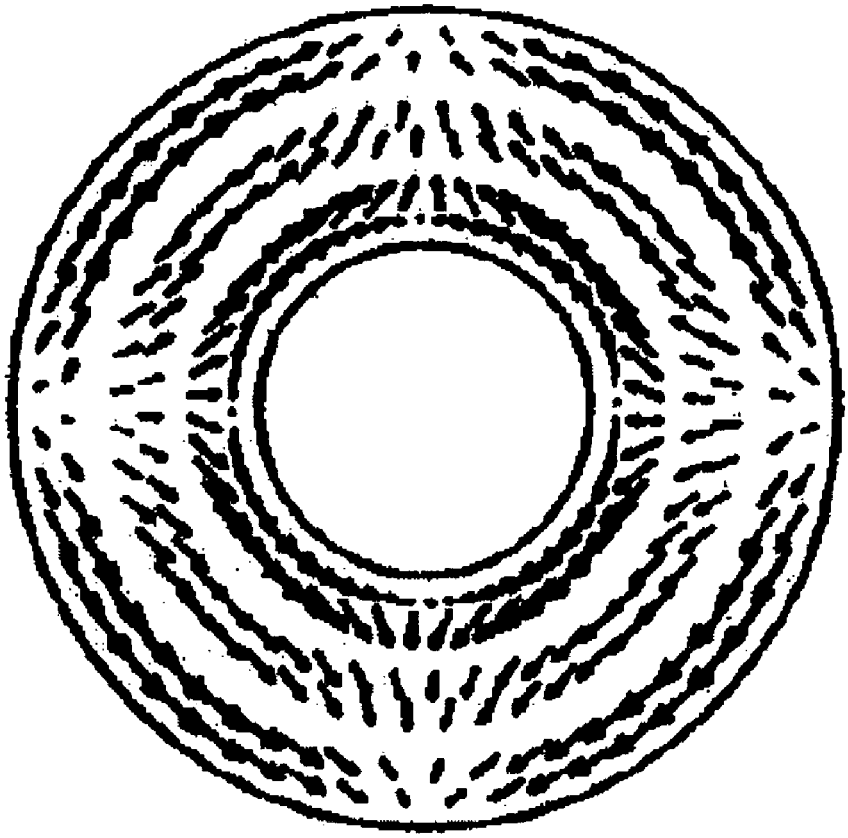
FIG. 4 is a current distribution diagram showing a relatively higher order operation mode (TM21) of the microstrip antenna on the ring-shaped radiant metal sheet in accordance with a first preferred embodiment of the present invention.

Please refer to FIG. 4, which is a current distribution diagram showing a relatively higher order operation mode (TM21) of the microstrip antenna on the ring-shaped radiant metal sheet in accordance with a first preferred embodiment of the present invention. In this figure, when operating the ring-shaped microstrip antenna in the relatively higher order operation mode, the current of the ring-shaped radiant metal sheet 302 mainly distributed in the inner edge and the outer edge of the ring is obtained, and the current direction of the inner edge and the out edge of the ring are identical.

Therefore, the first segment 3401 and the second segment 3403 of the metal feed line 304 are arranged and distributed in the inner edge and the outer edge of the ring-shaped radiant metal sheet 302 respectively. At the same time, if the length of the metal feed line 304 passing from the intersection A to the endpoint C is a length Ls, the current of the metal feed line 304 passing through the intersection A and the intersection B are the identical phase, and the current distribution of the ring-shaped radiant metal sheet 302 is matched successfully in the relatively higher order operation mode.

The abovementioned first length Ls is satisfies the relationship below:

$$\frac{(2\times n-1)}{2}\times L < Ls < n\times L,$$

n is a positive integer and L is a wavelength of the applied frequency of the microstrip antenna.

Figure 5:
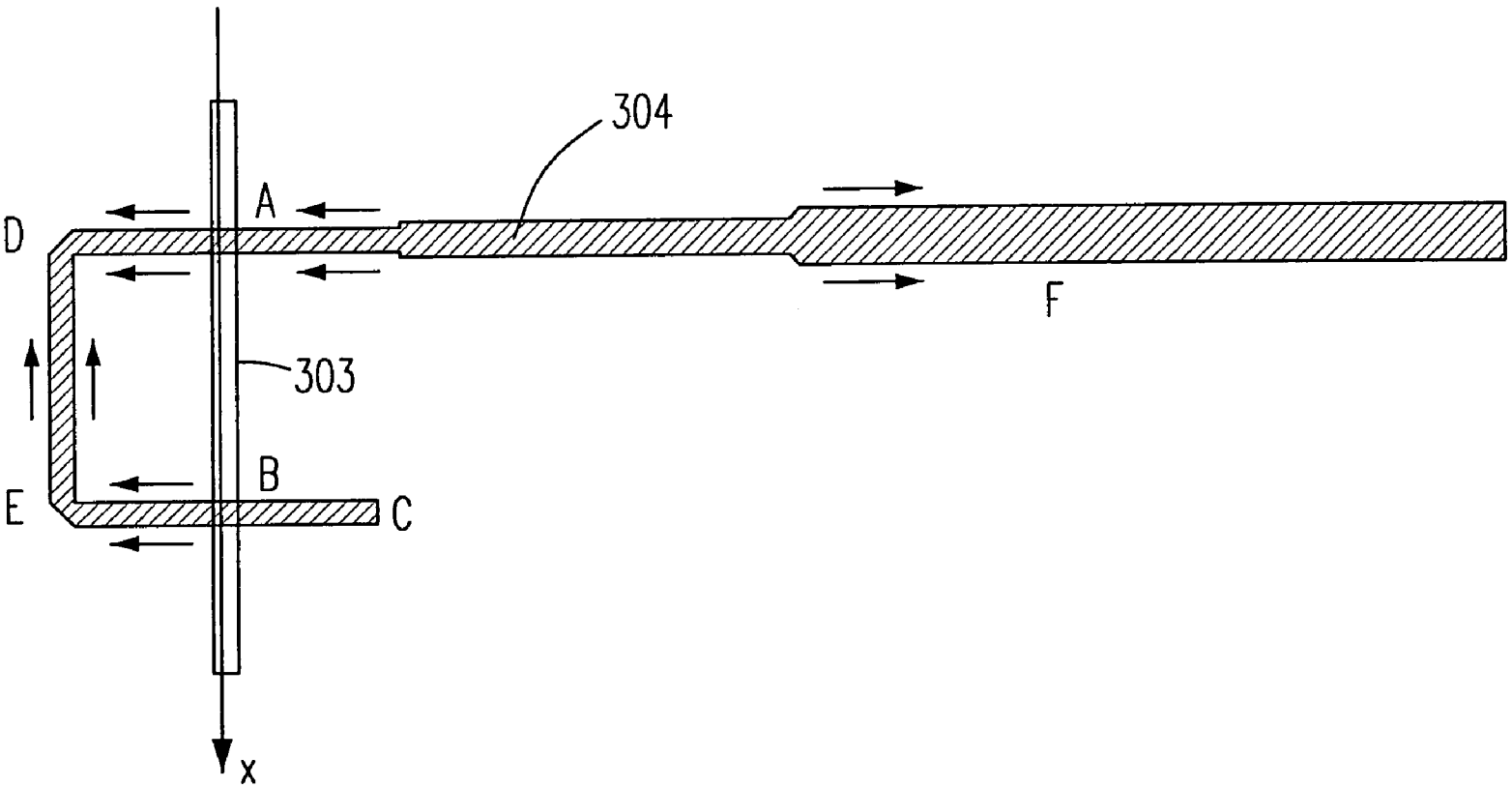
FIG. 5 is a current distribution diagram showing a metal feed line of the microstrip antenna satisfied the length condition in accordance with a first preferred embodiment of the present invention.
Figure 6:
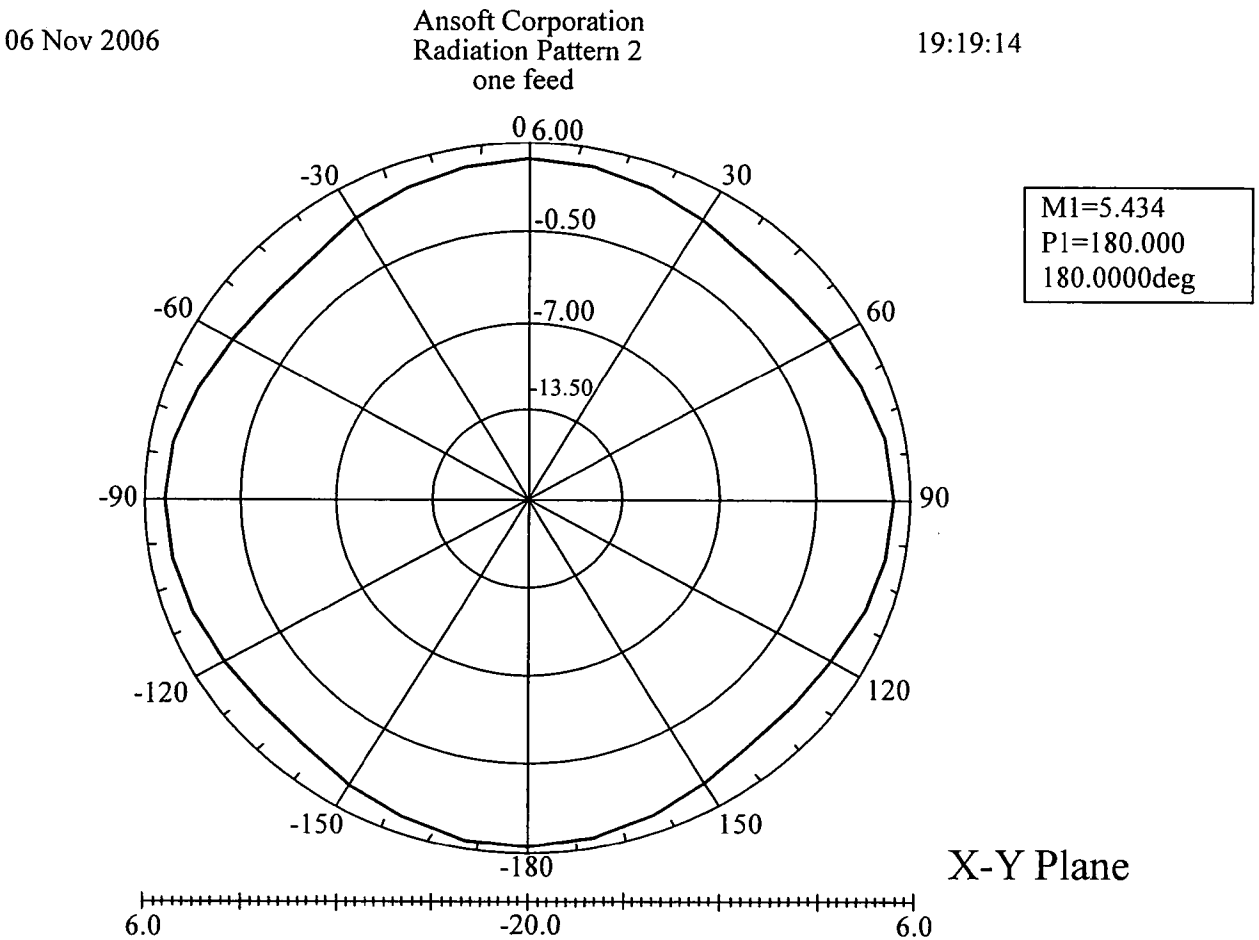
FIG. 6 is a data simulating diagram showing the radiation pattern result of the relatively higher order operation mode of the microstrip antenna in accordance with a first preferred embodiment of the present invention.
Figure 6:
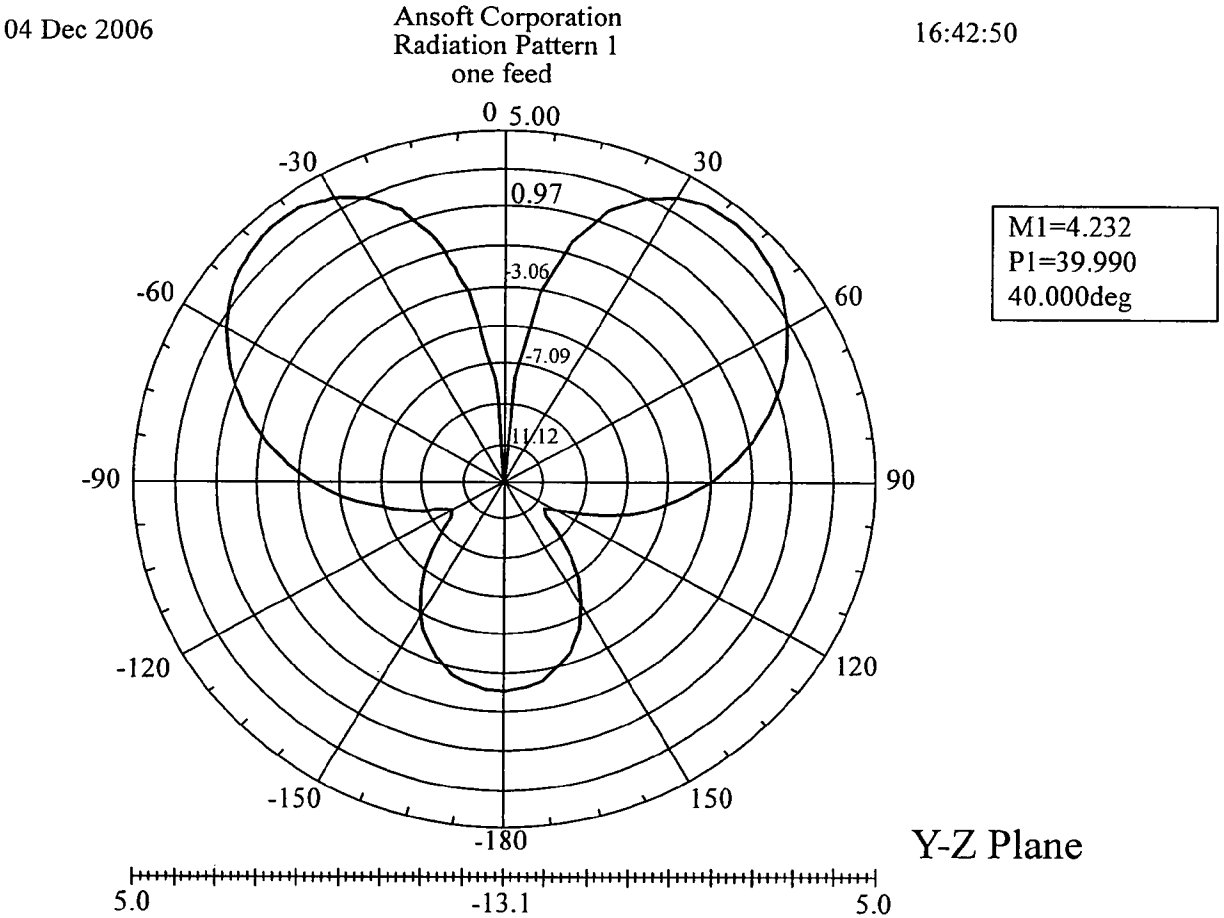
Figure 6:
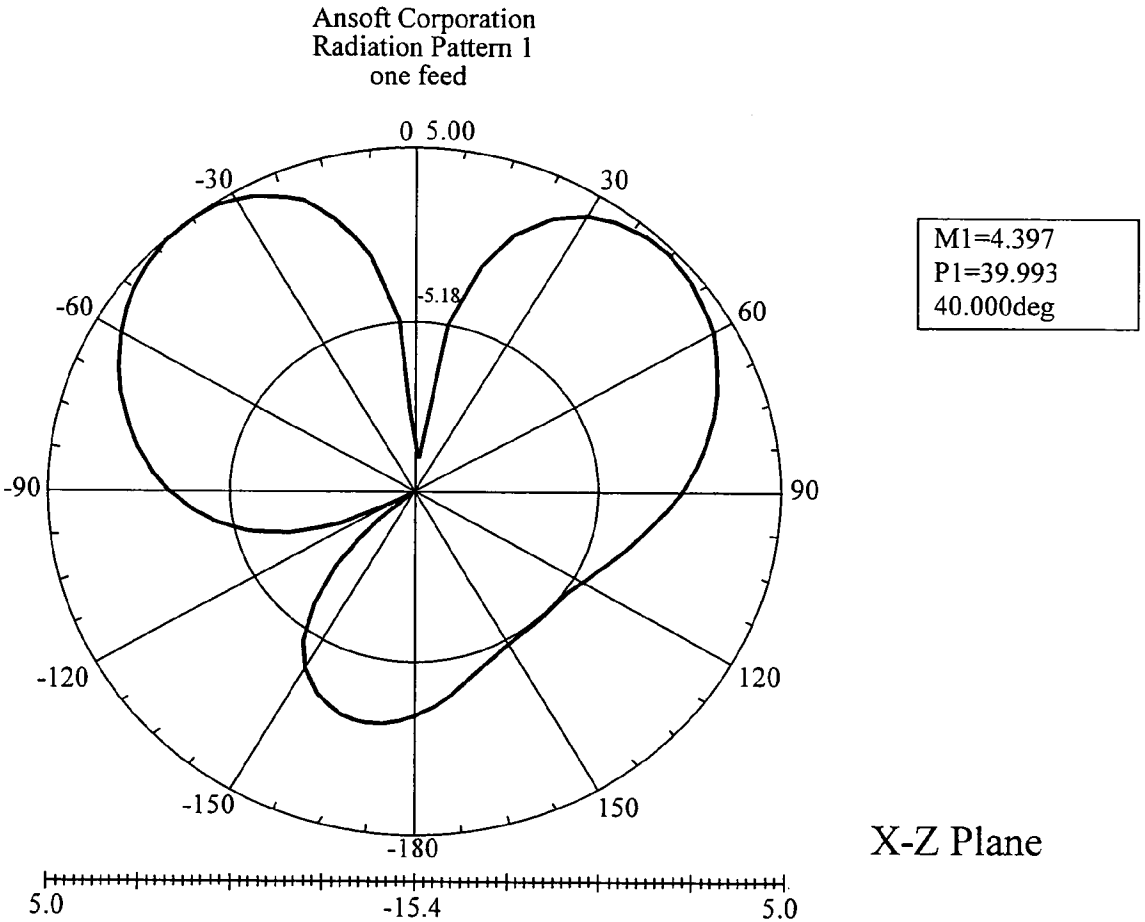

Please refer to FIG. 5, which is a current distribution diagram showing a metal feed line of the microstrip antenna satisfied the length condition in accordance with a first preferred embodiment of the present invention. Here, the relatively higher order operation mode of the microstrip antenna 30 is excited successfully, and the omnidirectional radiation pattern on the horizontal projection plane is obtained. As shown in FIG. 6, which is a data simulating diagram showing the radiation pattern result of the relatively higher order operation mode of the microstrip antenna in accordance with a first preferred embodiment of the present invention. In the figure, the omnidirectional radiation pattern is obvious on the horizontal plane (X-Y plane), and the excellent coverage is obtained on the vertical plane (Y-Z plane and X-Z plane).

Figure 7:
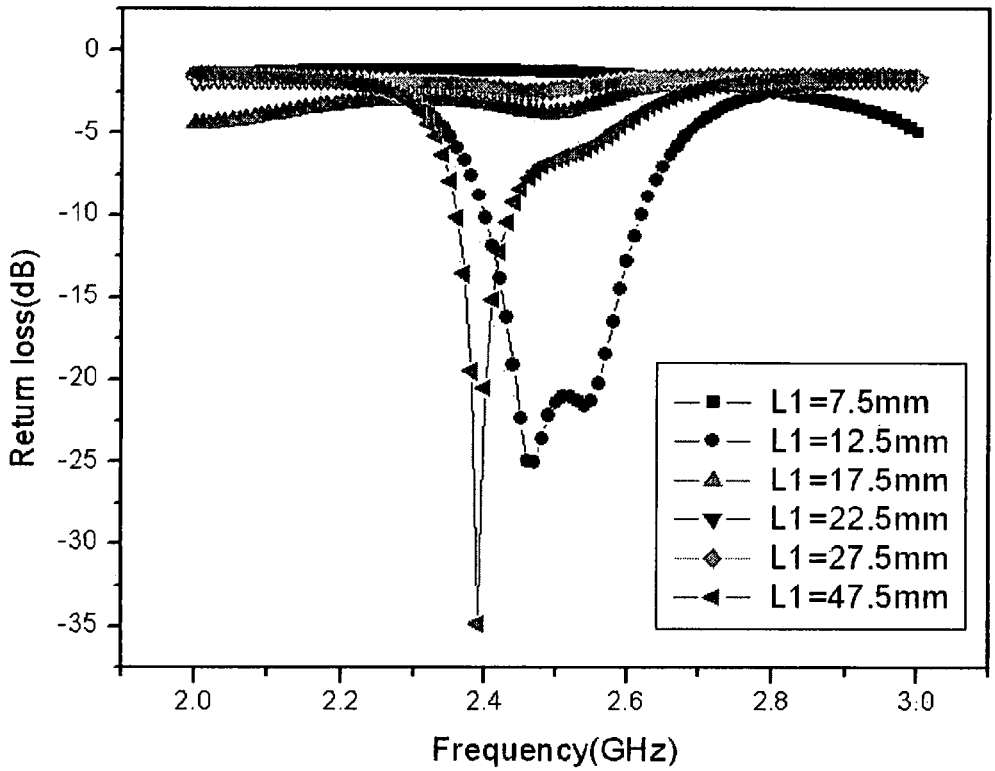
FIG. 7 is the diagram showing the frequency and the return loss of the first segment of different metal feed lines of the microstrip antenna in accordance with the a first preferred embodiment of the present invention.

Please refer to FIG. 7, which is the diagram showing the frequency and the return loss of the first segment of different metal feed lines of the microstrip antenna in accordance with the a first preferred embodiment of the present invention. The excellent impedance in particular is obtained with about 12.5 mm or 47.5 mm of the first segment length. The bandwidth of the antenna is about 220 MHz (9%), and the biggest antenna gain is 5 dBi. Therefore, the operation efficiency of the wireless network is achieved.

Figure 8:
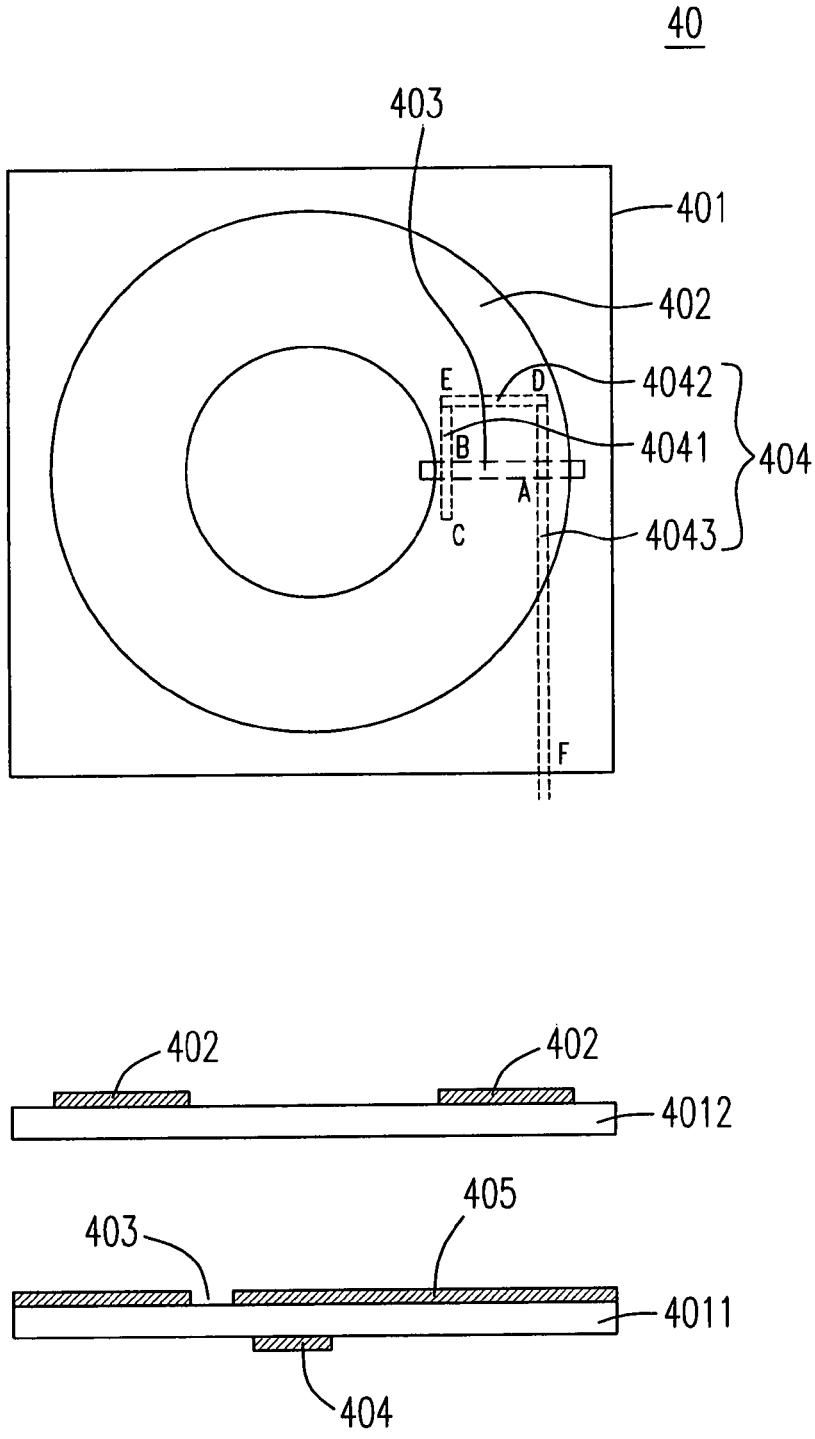
FIG. 8 is a structural diagram showing the microstrip antenna in accordance with a second preferred embodiment of the present invention.

Please refer to FIG. 8, which is the structural diagram showing the microstrip antenna in accordance with a second preferred embodiment of the present invention. In FIG. 8, a microstrip antenna 40 includes a first substrate 4011 and a second substrate 4012, wherein the second substrate 4012 is disposed and paralleled to the first substrate 4011, a ring-shaped radiant metal sheet 402 formed on the upper surface of the second substrate 4012, a metal ground plane 405 stuck on the upper surface of the first substrate 4011 arranged near to the second substrate 4012, a rectangular aperture 403 formed in the middle of the metal ground plane 405 in order to expose parts of the first substrate 4011, and a feed line 404 is in the lower surface of the first substrate 4011, and the feed line 404 formed on the lower surface. The feed line 404 is generally formed by a metal material in order to feed the signal received or transmitted by the microstrip antenna. The feed line 404 includes a endpoint C and a feeding point F linked to a signal processor (not shown in the figure), and a bending shape is formed on the horizontal projection plane.

The feed line 404 passes through one side of the rectangular aperture 403, bends and passes through the opposite side of the rectangular aperture 403 on the horizontal projection plane. Then an intersection A and an intersection B are formed on the horizontal projection plane, wherein the intersection A is arranged near to the feeding point F in the feed line 404 and the intersection B is arranged near to the endpoint C in the feed line 404.

The difference between the microstrip antenna 40 and the microstrip antenna 30 of the first embodiment simply lies in that the arrangement of the feed line 404 is the mirror image of the feed line 304 on the horizontal projection plane. The feed line 404 arranged near to the inner edge and the outer edge of ring-shaped radiant metal sheet 402 is linear, including a first segment (L1) 4041 arranged near to the inner edge of the ring-shaped radiant metal sheet 402 and a second segment (L2) 4043 arranged near to the outer edge of the ring-shape radiant metal sheet 402, wherein the first segment (L1) 4041 passes through the intersection B and the endpoint C and the second segment (L2) 4043 passes through the intersection A and feeding point F.

Figure 9:
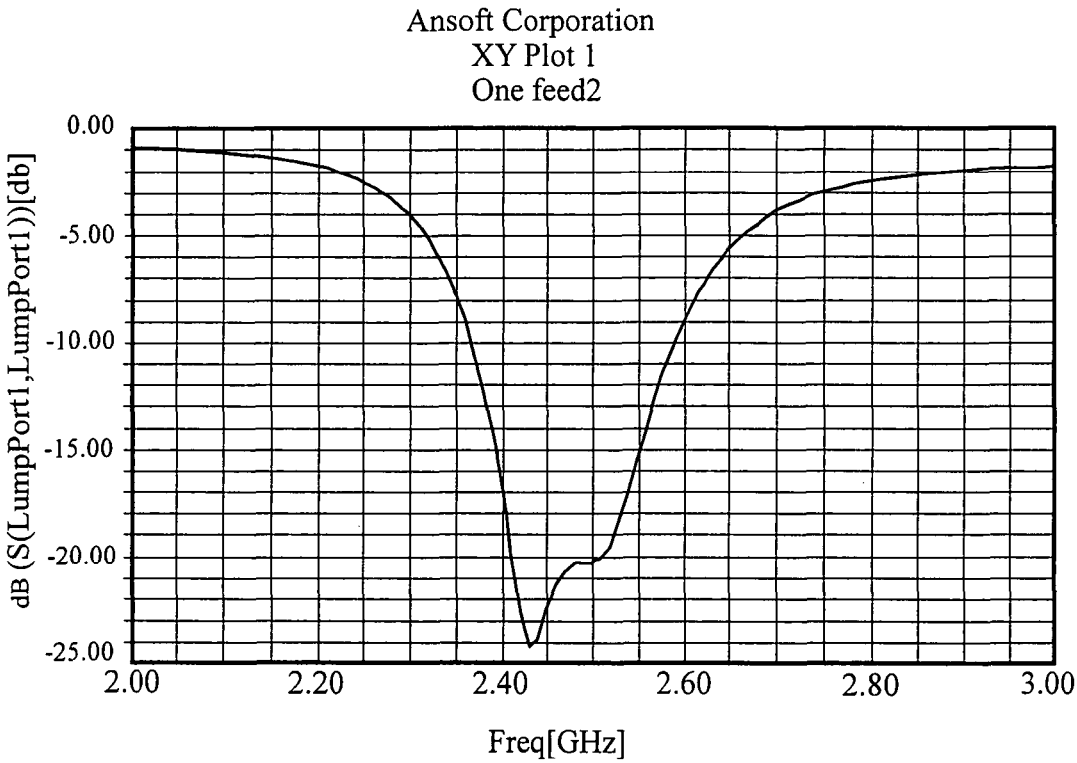
FIG. 9 is the diagram showing the frequency and the return loss of the relatively higher order operation mode of the microstrip antenna in accordance with a second embodiment of the present invention.

When the length of the feed line 404 from the intersection A to the endpoint C is the length Ls, the current distribution of the ring-shaped radiant metal sheet 402 also matches successfully with that in the relatively higher order operation mode, the relatively higher order operation mode of the microstrip antenna 40 is excited successfully, and the omnidirectional radiation pattern of the microstrip antenna is obtained on the horizontal projection plane. Please refer to FIG. 9, wherein is the diagram showing the frequency and the return loss of the relatively higher order operation mode of the microstrip antenna in accordance with a second embodiment of the present invention. It is recognized that the bandwidth of the microstrip antenna is about 200 MHz (9%), and the biggest antenna gain is also 5 dBi. Therefore, the obvious operation efficiency of the wireless network is achieved.

Figure 10:
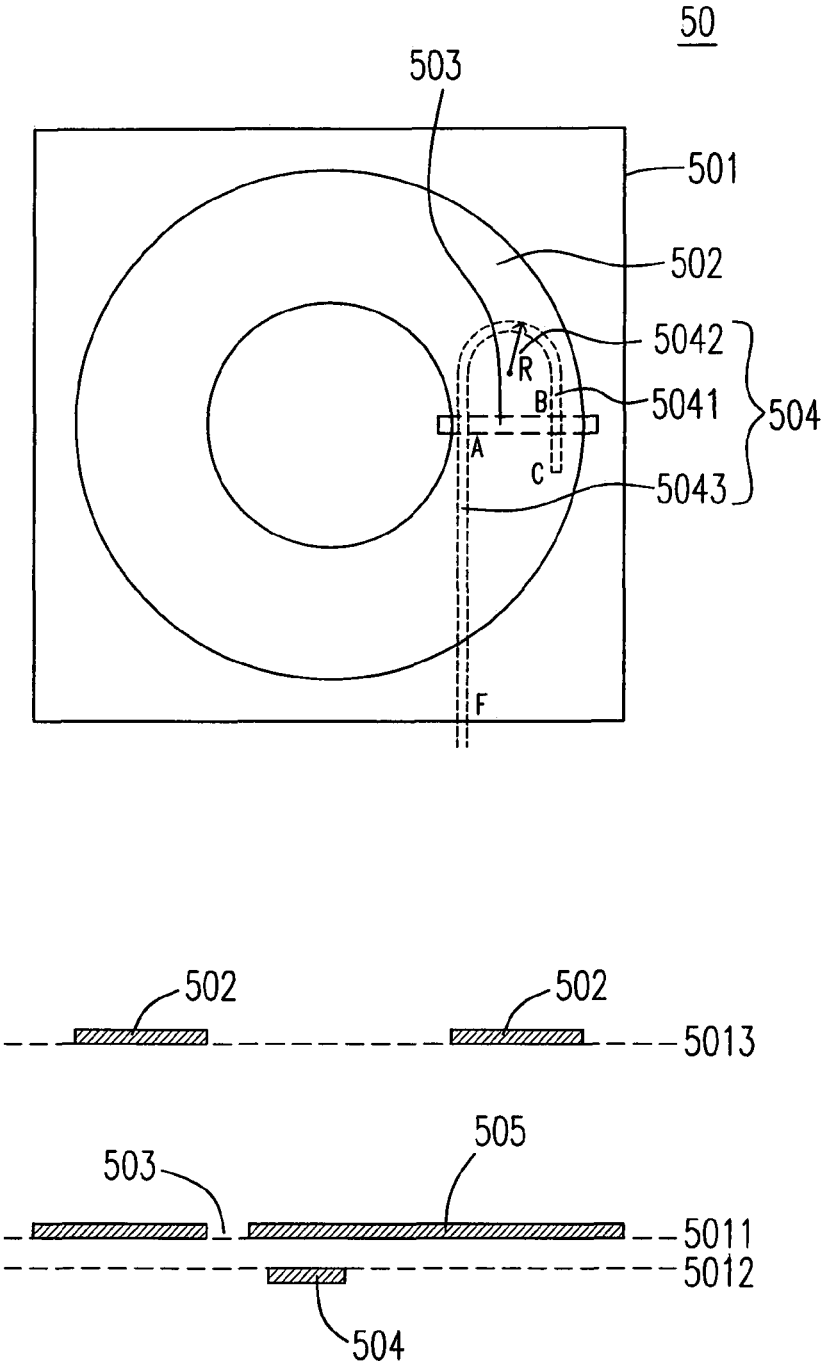
FIG. 10 is a structural diagram showing the microstrip antenna in accordance with a third preferred embodiment of the present invention.

Please refer to FIG. 10, which is a structural diagram showing the microstrip antenna in accordance with the third preferred embodiment of the present invention. In FIG. 10, a microstrip antenna 50 includes a metal ground plane 505, a feed line 504 and a radiant metal sheet 502, wherein the metal ground plane 505 is disposed on the first plane 5011, the feed line 504 is disposed on the second plane 5012 paralleled to the first plane 5011, the radiant metal sheet 502 is disposed on the third plane 5013 paralleled to the first plane 5011 and the second plane 5012 and is arranged in the opposite side of the first plane 5011 with respect to the second plane 5012. The radiant metal sheet 502 is a ring shape, and a rectangular aperture 503 is disposed on the metal ground plane 505. The rectangular aperture 503 passes through the ring-shaped radiant metal sheet 502 and lies in the radial direction of the ring shape on the horizontal projection plane.

The feed line 504 feeding the signal received or transmitted by the microstrip antenna is generally formed by a metal material. The feed line 504 includes a endpoint C and a feeding point F linked to a signal processor (not shown in the figure), and a bending shape is formed on the horizontal projection plane. The feed line 504 passes through one side of the rectangular aperture 503, bends and passes through the opposite side of the rectangular aperture 503 on the horizontal projection plane. Then an intersection A and an intersection B are formed on the horizontal projection plane, wherein the intersection A is arranged near to the feeding point F in the feed line 504 and the intersection B is arranged near to the endpoint C in the feed line 504. The feed line 504 arranged near to the inner edge and the outer edge of ring-shaped radiant metal sheet 502 is linear, including a first segment (L1) 5041 arranged near to the outer edge and a second segment (L2) 5043 arranged near to the inner edge, wherein the first segment (L1) 5041 passes through the intersection B and the endpoint C and the second segment (L2) 5043 passes through the intersection A and feeding point F. The first segment (L1) 5041 and the second segment (L2) 5043 are connected with a curved segment 5042 with a radius R.

Figure 11:
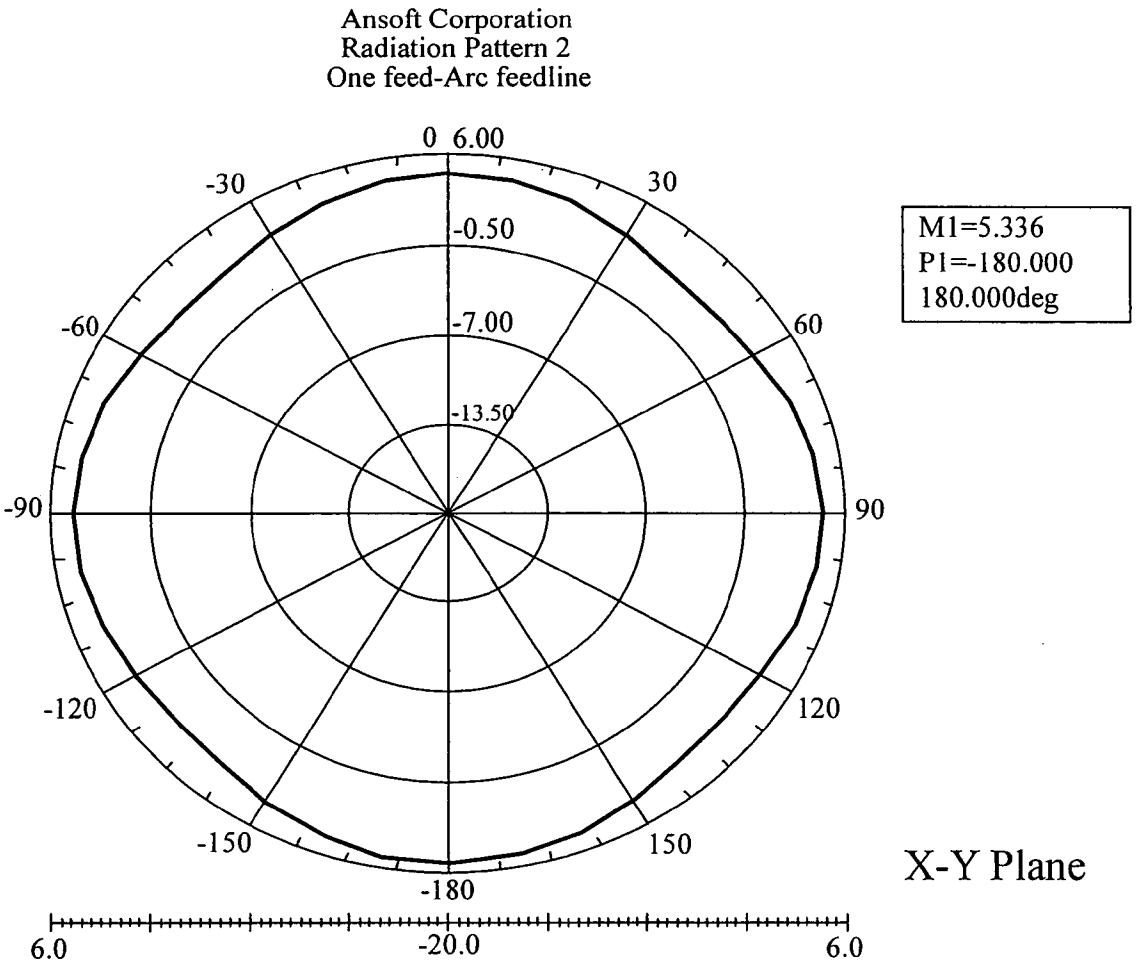
FIG. 11 is a data simulating diagram showing the radiation pattern result of the relatively higher order operation mode of the microstrip antenna in accordance with the a third preferred embodiment of the present invention.
Figure 11:
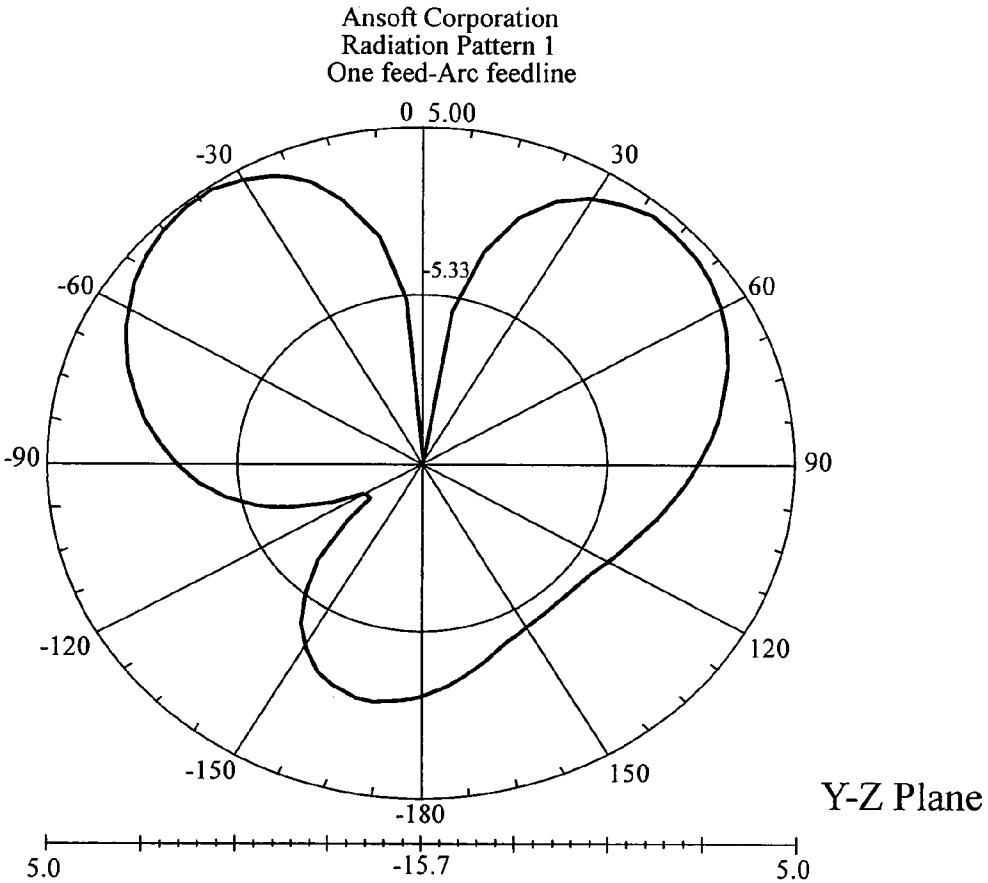
Figure 11:
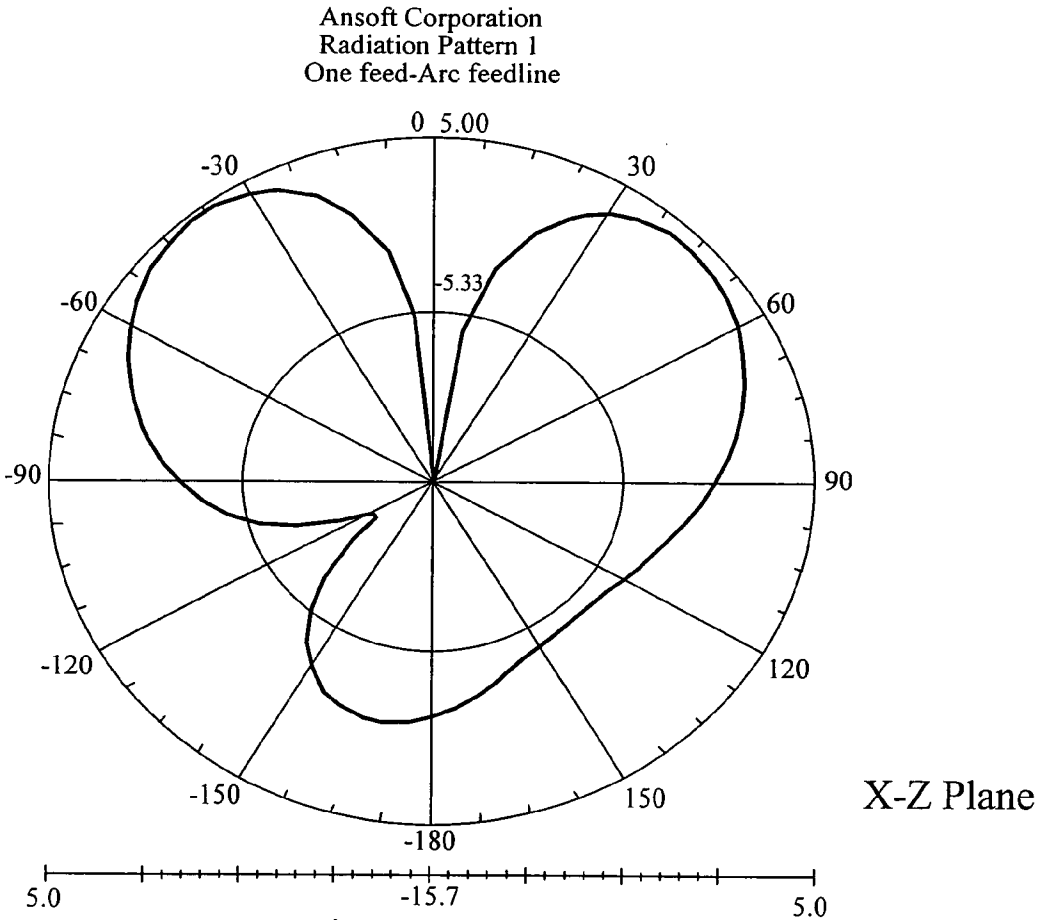

With regard to the length Ls satisfies the relationship below:

$$\frac{(2\times n-1)}{2}\times L < Ls < n\times L,$$

n is a positive integer and L is a wavelength of the applied frequency of the microstrip antenna. When the length of the feed line 504 from the intersection A to the endpoint C is the length Ls, the currents of the feed line 504 between the intersection A and the intersection B have the same phase. The current distribution of the ring-shaped radiant metal sheet 502 is matched successfully in the relatively higher order operation mode, and the relatively higher order operation mode of the microstrip antenna 50 is excited successfully. Please refer to FIG. 11, which is the data simulating diagram showing the radiation pattern result of the relatively higher order operation mode of the microstrip antenna in accordance with a third preferred embodiment of the present invention. In the figure, the omnidirectional radiation pattern is significant on the horizontal plane (X-Y plane), and the excellent coverage is also obtained on the vertical plane (Y-Z plane and X-Z plane).

Figure 12:
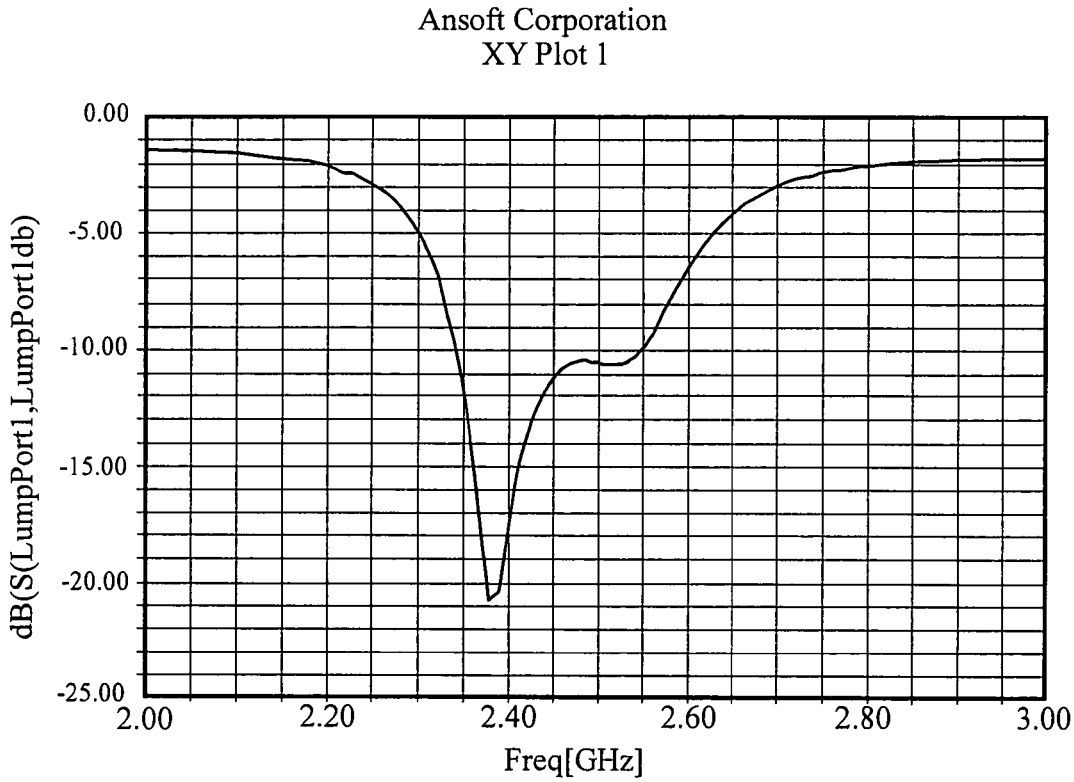
FIG. 12 is the diagram showing the frequency and the return loss of the relatively higher order operation mode of the microstrip antenna with 7.5 mm of the radius (R) of the arc and 8.5 mm of the first segment (L1) 8.5 mm in accordance with a third preferred embodiment of the present invention.

Preferably, the excellent impedance in particular is obtained with 7.5 mm of the radius of the curved segment 5012 and 8.5 mm of the length of the first segment. Please refer to FIG. 12, which is the diagram showing the frequency and the return loss of the relatively higher order operation mode of the microstrip antenna in accordance with a third preferred embodiment of the present invention. It is known that the bandwidth of the microstrip antenna is about 200 MHz (9%), and the biggest antenna gain is 5 dBi. Therefore, the obvious operation efficiency of the wireless network is achieved.

In conclusion, the present invention is to arrange skillfully the feed line of the aperture coupled microtstrip antenna, so that an excellent impedance is obtained in order to excite the relatively higher order operation mode of the microstrip antenna, an excellent radiation pattern is maintained, and the bandwidth of the wireless network in the 2.4 GHz application is increased efficiently.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A microstrip antenna, comprising:

(a) a first substrate with a first surface and a second surface paralleled to each other;

(b) a metal ground plane with a rectangular aperture disposed on the first surface and exposing parts of the first substrate via the rectangular aperture;

(c) a ring antenna having a current phase distribution; and (d) a metal feed line disposed on the second surface, wherein the metal feed line has a current phase distribution matched with the current phase distribution of the ring antenna so as to excite a relatively higher order operation mode of the ring antenna, and a first and a second intersections with the rectangular aperture on a horizontal projection plane, in order to feed a signal received or transmitted by the microstrip antenna, wherein the rectangular aperture has a longer side and a shorter side, the metal feed line has an endpoint and a current feeding point, the first intersection is arranged near the endpoint, the second intersection is arranged near to the current feeding point, and a characteristic length from the endpoint to the second intersection is ranged between $$\frac{(2\times n-1)}{2}\times L \text{ and } n\times L$$

wherein n is a positive integer and L is a wavelength of an applied frequency of the microstrip antenna.

2. The microstrip antenna of claim 1, further comprising a second substrate paralleled to the first substrate, wherein the second substrate has a radiant metal sheet with a ring shape to be the ring antenna.

3. The microstrip antenna of claim 2, wherein the rectangular aperture passes through the radiant metal sheet on the horizontal projection plane and lies in a radial direction of the ring shape.

4. The microstrip antenna of claim 2, wherein the metal feed line is a continuous bending segment comprising a first segment and a second segment, wherein the first segment passes through the endpoint and the first intersection, the second segment passes through the current feeding point and the second intersection, and the first segment and the second segment are arranged near to an inner edge and an outer edge of the ring shape, respectively.

5. The microstrip antenna of claim 4, wherein the first and the second segments are perpendicular to the longer side of the rectangular aperture on the horizontal projection plane.

6. The microstrip antenna of claim 2, wherein at least one of the first substrate and the second substrate is a dielectric substrate.

7. The microstrip antenna of claim 1, wherein the metal feed line further comprises a third segment connected to a first segment and a second segment.

8. The microstrip antenna of claim 7, wherein the third segment is parallel to the longer side of the rectangular aperture on the horizontal projection plane.

9. A microstrip antenna, comprising:

(a) a metal ground plane disposed on a first plane and having a rectangular aperture formed thereon;

(b) a ring antenna having a current phase distribution; and (c) a feed line having a current phase distribution matched with the current phase distribution of the ring antenna so as to excite a relatively higher order operation mode of the ring antenna, and disposed in a second plane paralleled to the first plane, wherein the feed line has a first and a second intersections with the rectangular aperture on a horizontal projection plane, in order to feed a signal received and transmitted by the microstrip antenna, wherein the rectangular aperture has a longer side and a shorter side, the metal feed line has an endpoint and a current feeding point, and the first intersection is arranged near the endpoint, the second intersection is arranged near to the current feeding point, and a characteristic length from the endpoint to the second intersection is ranged between $$\frac{(2\times n-1)}{2}\times L \text{ and } n\times L$$

wherein n is a positive integer and L is a wavelength of an applied frequency of the microstrip antenna.

10. The microstrip antenna of claim 9, wherein the feed line is formed by a metal material.

11. The microstrip antenna of claim 9, wherein the first plane and the second plane are disposed on a dielectric substrate with a first surface and a second surface, where the first plane and the second plane are carried by the first surface and the second surface, respectively.

12. The microstrip antenna of claim 9, further comprising a radiant metal sheet with a ring shape formed in a third plane paralleled to the first plane, wherein the third plane is arranged in an opposite side of the first plane with respect to the second plane to form the ring antenna.

13. The microstrip antenna of claim 12, wherein the rectangular aperture has a longer side and a shorter side, the longer side of the rectangular aperture is formed in a radial direction of the radiant metal sheet on the horizontal projection plane, and an extension line of the longer side passes through a center point of the radiant metal sheet.

14. The microstrip antenna of claim 12, wherein the radiant metal sheet is formed on a dielectric substrate.

15. The microstrip antenna of claim 12, wherein the first plane and the second plane are insulated by an air medium, so are the second plane and the third plane.

16. The microstrip antenna of claim 9, wherein the feed line is a continuous bending segment comprising a first segment and a second segment, wherein the feed line further comprises a curved segment connected to the first segment and the second segment.

17. The microstrip antenna of claim 16, wherein the curved segment is an arc.

* * * * *